United States Patent [19]

Güthoff

[11] 4,277,899

[45] Jul. 14, 1981

[54] EXCAVATING MACHINE WITH POSITION INDICATION OF ITS WORK IMPLEMENT

[75] Inventor: Wilfried Güthoff, Witten-Annen, Fed. Rep. of Germany

[73] Assignee: Friedrich Wilh. Schwing GmbH, Herne, Fed. Rep. of Germany

[21] Appl. No.: 98,825

[22] Filed: Nov. 30, 1979

[30] Foreign Application Priority Data

Dec. 1, 1978 [DE] Fed. Rep. of Germany ..... 2851942

[51] Int. Cl.[3] ..... E02F 5/02

[52] U.S. Cl. ..... 37/103; 37/DIG. 19

[58] Field of Search ..... 37/103, DIG. 19, 117.5; 172/809; 116/306, 307

[56] References Cited

U.S. PATENT DOCUMENTS

| | | | |
|---|---|---|---|
| 2,704,047 | 3/1955 | Lushenko | 37/DIG. 19 |
| 3,349,747 | 10/1967 | Wiele | 172/809 X |
| 4,028,822 | 6/1977 | Teach | 37/DIG. 19 |
| 4,050,171 | 9/1977 | Teach | 37/DIG. 19 |

FOREIGN PATENT DOCUMENTS

| | | | |
|---|---|---|---|
| 491649 | 3/1953 | Canada | 37/DIG. 19 |
| 705034 | 3/1965 | Canada | 37/DIG. 19 |
| 1195681 | 6/1965 | Fed. Rep. of Germany | 37/DIG. 19 |
| 2262399 | 7/1973 | Fed. Rep. of Germany | 37/DIG. 19 |
| 306231 | 9/1971 | U.S.S.R. | 37/DIG. 19 |
| 374421 | 4/1973 | U.S.S.R. | 37/DIG. 19 |

*Primary Examiner*—E. H. Eickholt

*Attorney, Agent, or Firm*—Andrus, Sceales, Starke & Sawall

[57] ABSTRACT

An excavating machine has an indicator (60, 64) showing the position of the boom and dipper stick mounted back hoe (29) to the machine operator. A guide rod (33) is coupled to the hoe and to a swivel joint (34) on the machine to drive the indicator. The angle of the hoe may be shown by an additional indicator (83, 84).

10 Claims, 5 Drawing Figures

Figure 1:
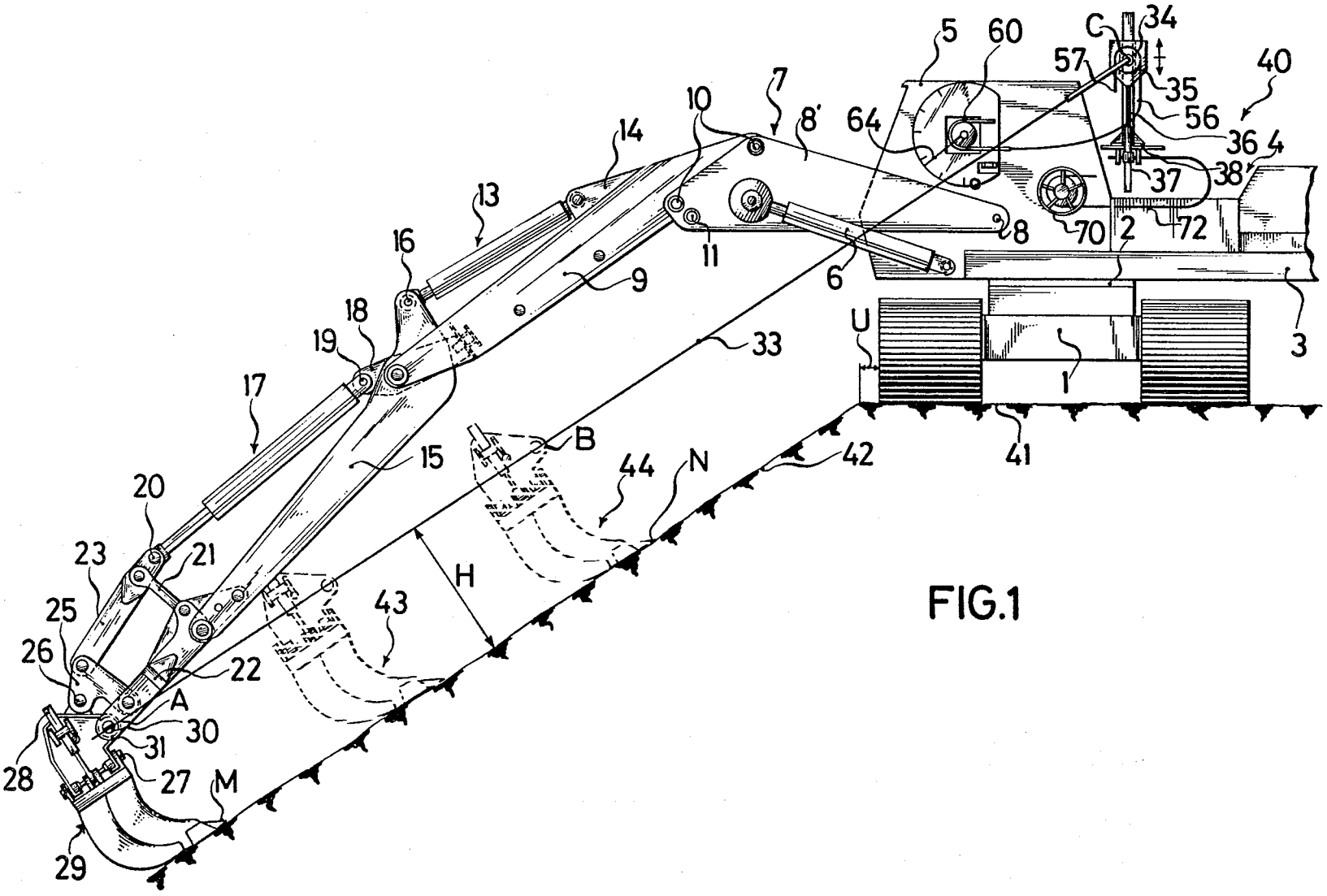

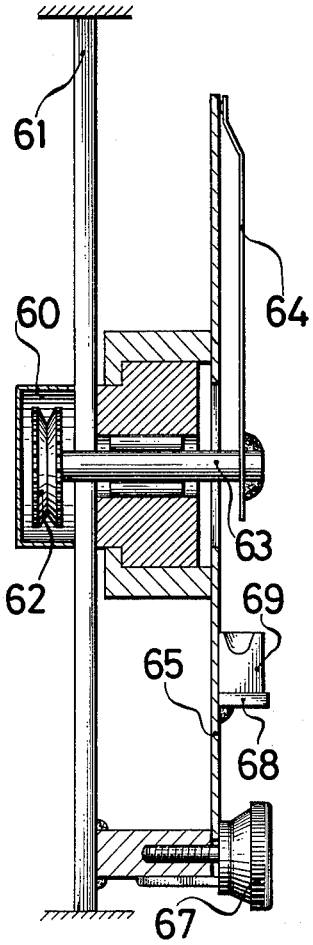
FIG. 2
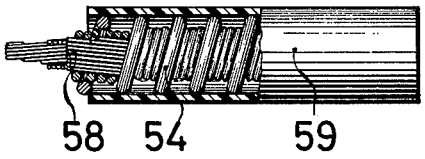
FIG. 4
FIG. 5
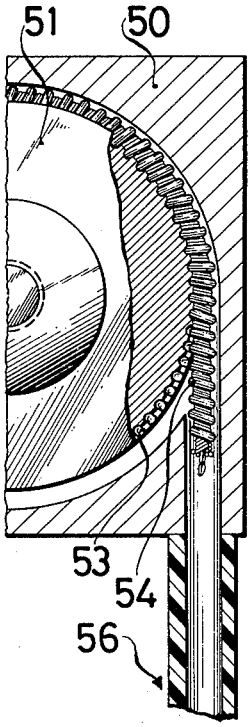

EXCAVATING MACHINE WITH POSITION INDICATION OF ITS WORK IMPLEMENT

The invention relates to an excavating machine with position indication of its preferably parallel guided working implement, formed for example as a ditcher or back hoe. The working implement is movable by means of a pivoting drive about a pivot joint of a dipper stick that is rotatably fastened with a further pivoting drive on a preferably multiple part boom articulated on the excavating machine upper part.

The invention is particularly suited for hydraulically driven excavating machines, with which are produced and worked, from a plane, preferably descending embankments with a specified embankment angle, in particular when the embankment itself is impassable with the excavating machine and is entirely or partially not observable by the excavating machine operator. This occurs in hydraulic construction, for example with the bringing up of canal banks from the plane canal crest. With the preferred exemplary embodiment of the excavating machine according to the invention, the working implement is pivotably joined through a pivot lever or through a linkage parallelogram on the swivel joint of the dipper stick. With this type of excavating machine, the working implement is lead parallel through exact dimensioning of the parallelogram, in which the linkage, the dipper stick, and the working implement are included as well as through articulation of the drive cylinder belonging to the dipper stick on the boom instead of on the dipper stick itself. That considerably facilitates, for the excavating machine operator, the dressing of embankments, because he, with the working, has to control only the boom cylinder and needs not to control the back hoe cylinder. With such an excavating machine the boom can be multipart, however the parts thereof are fixed in a definite relationship to each other corresponding to the desired embankment.

Excavating machines of this type without position indication of thier working implement are known. Generally, the working of an incline with higher demands in the observance of a predetermined embankment angle requires also of the excavating machine operator at least one additional worker, who carries out the measurements necessary to the continual control and dressing of the incline and advises the excavating machine operator, when he has to undertake the corresponding correction. Particularly expensive however is the laying out of slopes underneath the water surface, because for control of the evenness and inclination of the embankment part lying under the water at least three further workers are necessary. With a stopping of the excavating machine, these men must verify the embankment angle from a boat with a stadia rod and with a surveyor's tape out from the shore and must direct the excavator operator.

Also known are dredges with position indication of their, for example, back hoe formed working elements. The position indication is based on the principle of using a scaled down reproduction of all controllable, movable parts of the excavator to control the actual movement of the original part and to represent the predetermined slope through a template from the model mounted in the field of view of the excavating machine operator. The reproduction of the dredger in a true to scale, controllable model means an unusual technical expenditure, that is only justified with larger excavating machine installations that as a rule cannot be utilized for operation from land. For such dredges are such position indications also therefore useless, because they possess insufficient correction possibilities for different positions of the dredge in relation to the surface. The reproduction of the slope with a template means that corresponding to the correct scale reduction, errors are translated on the original working element with the control of the model working implement along the template. The exact adherence to the predetermined angle is hence not attainable with such position indication.

The present invention has as its object to so arrange the position indicator that it continuously indicates to the excavating machine operator, at least the course of the movement path of the working implement relative to the plane of the produced surface, that is, the embankment and so offers to the excavating machine operator the possibility to bring the movement path of the working implement into conformity with the required surface, that is, the selected course of the embankment without needing therefore measurements to be performed by assistants.

This object is obtained according to the invention, in that for the position indication an indicator is provided that is controlled by a guide element that represents a connection between the swivel joint of the working element and an axis parallel basic swivel joint on the pivotable excavating machine upper part and that the position indication is calibratable in the indicator scale for inclination of the excavating machine in the guide element plane and is calibratable for different spacing of the excavating machine from the work plane through elevation adjustment of the axis parallel swivel joint on the excavating machine.

The respective inclination of the guide element in the plane of the boom and the dipper stick reproduces in any case then an exact measurement, for example, of an embankment angle, if one takes into consideration the distance of the excavating machine from the embankment edge, through elevation adjustment of the axis parallel swivel joint on the excavating machine. The respective regulation of the linkage one can very simply obtain in the following way: one produces first a part of the required embankment; with embankments lying partially under the water, the part lying above the water corresponds to the specification. One then positions the working implement on this finished part of the embankment and needs now only to adjust the height of the axis parallel swivel joint until the controlled indicator shows the correct embankment angle on the scale. One works the embankment not in the line of the steepest gradient, for one can achieve the correction through feed back of the already produced embankment with the working implement and through adjustment of the articulation until the observance of a predetermined indicator position. Any inclination of the excavating machine can be taken into consideration in the adjustable indicator scale through the use of a level. What applies to embankments, correspondingly applies to a plane surface that for example is to be constructed at the foot of the embankment.

The operator of the excavating machine after effecting the correction needs only to so control the excavating machine that the indicator on the scale maintains the initially set position, in order to construct a predetermined embankment. Errors are not translated, but appear in similar size as in the working implement; therefore they are easy to avoid or to correct.

With hoes, and particularly with back hoes, the control of the position of the working implement is quite practical for the production of an exact surface, that is, a predetermined inclination of the embankment according to necessary precise specifications. In this case the invention provides that the pivot angle of the working implement about its swivel joint is reproduced on a further scale with a controlled, separate indicator.

With the initially mentioned excavating machine with a parallel guided back hoe, in which the invention is preferably applicable, the reproduction of the pivot angle is particularly simple because it depends only on the extended length of the piston rod of the hoe pivot drive mounted between the boom and back hoe.

The guide rod can be so formed that it not only represents the connection between the swivel joint of the working implement and axis parallel base swivel joint on the pivotal dredging machine upper part, but is actually so formed. For this purpose the invention provides that the guide is radially guided in the swivel joint of the work tool, because then the guide rod need not be variable in length; or the guide rod is fastened in the swivel joint and formed changeable in length between its mounting in the swivel joint of the working implement and the base swivel joint. That can occur in different ways. For such an embodiment is suited a rubber cord, a steel cable which is lead through a guide pulley that forms the axis parallel basic swivel joint, as well as a telescopable linkage.

In many cases however embodiments of the invention are practical, by which the guide element only indicates but does not actually form the connection between the swivel joint of the working implement and the parallel axis base swivel joint, because then the linkage parts mounted with the back hoe under the boom and dipper stick are largely inapplicable. In these cases the system points of the boom and the dipper stick are reproduced reduced and forced to synchronism. With the fixing of the boom parts and the movable dipper stick according to the preferred excavating machine of the invention the guide rod is shortened through articulation on a rocker arm pivoted on the boom, that represents a shortening of the dipper stick corresponding to the selected shortening of the boom and is controlled by the rotary angle of the connection link between the boom and the dipper stick.

Figure 3:
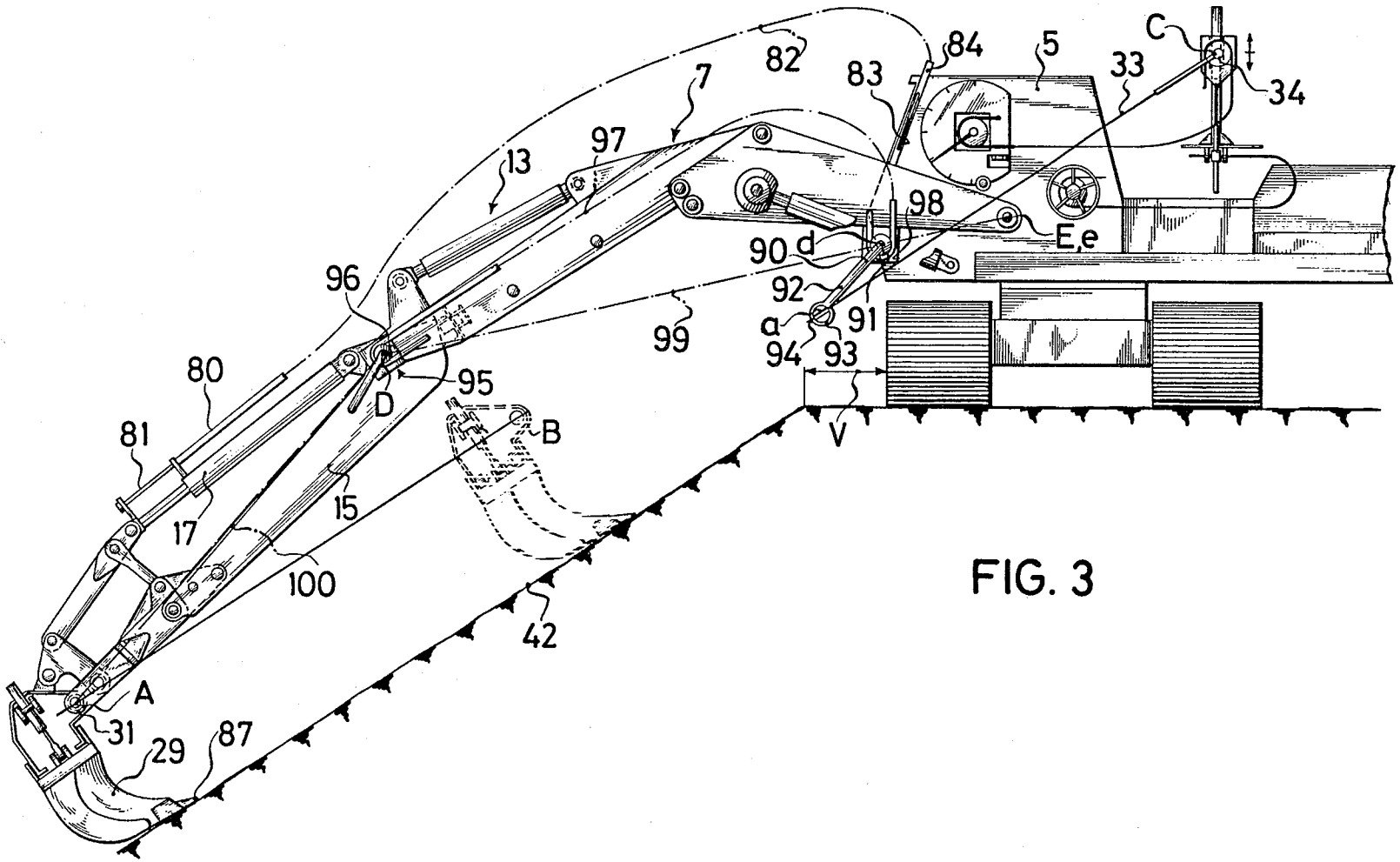

The details, further features, and other advantages of the invention will become apparent from the following description of the two exemplary embodiments with the aid of the figures of the drawing. The drawings show as follows;

FIG. 1, in side view, an excavating machine according to the invention with position indication according to a first exemplary embodiment of the invention, FIG. 2, in enlarged reproduction and in side view, a representation of the indicator mechanism including the necessary correction device for the accommodation of the inclination of the upper part of the excavating machine, FIG. 3, in a view corresponding to FIG. 1, a modified exemplary embodiment of the invention, FIG. 4 the flexible part of a device for the control of a swivel joint, and FIG. 5 the receiver part that coacts with the apparatus according to FIG. 4.

According to the showing of FIG. 1, an excavating machine upper part 3 is pivotally supported on a crawler vehicle 1 by means of a turntable 2. The upper part is schematically represented and the apparatus portions applicable to the invention are enlarged for better understanding. The pivotable excavating machine upper part 3 carries the customary drive 4 and a cab 5 for the excavating machine operator. By means of a first actuating cylinder 6, a boom 7 can pivot hydraulically about a horizontal pivot point 8 on upper part 3. The boom is, according to the disclosed exemplary embodiment, formed of two parts 8' and 9. By means of bolts 10 and 11, the parts are, however, are locked together.

By means of a second hydraulic actuating cylinder 13 that is pivoted on boom 7 at 14 and in a dipper stick 15 at 16, the dipper stick can swing in the plane of boom 7. A third hydraulic cylinder 17 is pivotally connected at 19 with a part 18 locked with the boom 7; its piston rod is connected at 20 in a guide link parallelogram, that is formed from a rocker arm 21, two approximately parallel links 22 and 23, as well as a crank 25. The crank 25 is linked at 26 on a backhoe generally indicated with 29 and pivotable about an axis 27 by means of a hydraulic cylinder 28. This linkage serves however, merely for the transfer of the pivotal movement that arises from the hydraulic cylinder 17. The work implement 29 is pivotable about the pivot joint 30, the link axis of which is indicated with A. It is formed from a link bolt, that locates a radial guide 31. The radial guide serves for the mounting of a rod 33 that is only schematically reproduced, and forms a control lever, that is pivoted in a parallel axis base swivel joint 34. The pivot axis of this joint is shown with C. The joint is positioned in a yoke 35 that is mounted on a spindle 36, that is controlled by a nut 37. The device is located on a bracket 38, that can be fastend at a desired location outside the cab 5 on the excavating machine upper part 3.

The excavating machine, indicated in general by 40 also stands horizontally aligned on the plane 41 that is formed from the crown of a dike. The embankment is shown by 42. Different positions of the parallel guided back hoe 29 are reproduced by 43 and 44, shown in phantom. The parallel guiding is achievated through corresponding dimensioning of the linkage parallelograms that on the one hand are formed from the parts 17, 21, 15 and 18 and on the other hand are formed from the parts 21–25 as well as ultimately from the parts 22 and 25 as well as the upper part of the working implement 29. Further, the pivoting of the hydraulic cylinder 17 on boom 7 is determinative of the parallel guiding. Apart from the dumping out and repositioning of the excavating machine back hoe the cylinder 17 does not need to become operative. The production of the embankment occurs solely with the cylinder 13.

The straight line through the points A, B and C is represented by the rod 33. The guide rod admits every movement of the boom and the dipper stick 15 as a result of its guiding at 31 and its hinging at 34.

The swivel joint 34 is provided with a device, that is reproduced in FIG. 5 and in essence is formed of a fastened holder 50 and a rotatable wheel 51, that moves in correspondence to the pivotal movement of guide rod 33. On its periphery the wheel 51 has a toothing 53 that corresponds to the toothing 54 of a flexible rack 56. The end of the rack is guided by 57. The rack itself is formed of a sheathing of a flexible cord 58 that for its part is protected as well as surrounded by a casing 59.

A corresponding container 60 is mounted in the cab of the excavating machine operator. The container is schematically reproduced in FIG. 2 on a supported carrier 61. The toothed disc 62 is positioned on an indicator shaft 63, the indicator of which 64 runs over a scale, which, in turn is mounted on a disc 65. The disc 65 can tilt about the geometric axis of shaft 63 when a milled screw 67 that serves for the fixing of the scale position has been loosened. According to the exemplary embodiment the housing 68 of a level 69 is mounted on the disc 65. With the described apparatus, the scale on the disc 65 can be calibrated according to the respective deviation of the position of the excavating machine carriage 1 from the horizontal.

By means of a hand-wheel 70 mounted in the cab, the nut can be rotated from the cab through a flexible rack 72 of the type shown in the embodiment of FIGS. 4 and 5 so that the height of the point C can be changed through the spindle 36.

According to the disclosed examplary embodiment, the excavating machine has the spacing U from the embankment edge. Initially a part of the embankment 42 is prepared with the correct angle, in the exemplary embodiment 33.7°. When this has taken place, the excavating machine operator places the back hoe 29 on this finished part of the embankment and adjusts the point C by means of the hand-wheel 70 until the indicator 64 indicates the correct slope value on the scale. Previously he has, of course, correspondingly calibrated the scale with the use of level 69. As a result of the above described parallel guiding can at this stage the entire embankment be prepared, whereby thereafter, it need only by observed that the indicator 64 indicates the selected embankment angle. If the excavating machine is displaced, then the adjustment must be again undertaken, insofar as the distance U has changed. The plane surface is then correct, if the digging movement from M to N, that is A to B, results in no change of the indicator position and the correct value is indicated.

The exemplary embodiment according to FIG. 3 differs from the exemplary embodiment according to FIG. 1 initially in that the extended length of the cylinder 17 is lead through a cylinder mounted tube 80 by a rod 81 mounted on the piston so that it is transmitted through a flexible Bowden control cable 82 to an indicator 83 that moves in a casing 84, that is mounted on cab 5. The indicator 83 can move on a scale, that reproduces the angle position of back hoe 29 and therewith the position of the teeth 87 against the embankment 42. The device rests with the disclosed exemplary embodiment on the described parallel control of the back hoe 29 but can be correspondingly formed with other excavating machines.

The exemplary embodiment according to FIG. 3 differs from the exemplary embodiment according to FIG. 1 further in that the guide rod 33 does not form the actual connection of the pivot joint 31 with the base swivel joint, but merely represents these geometrically. For this purpose a parallel axis pivot joint 91 is arranged in a bracket 90, that serves for the mounting of a rocker arm 92. The rocker arm 92 has a length corresponding to the system of the dipper stick 15 through consideration of the length of the line 99. It thus represents a reduced reproduction of the boom system. Accordingly the outer end of the rocker arm 92 is provided with a swivel joint 93, that has the described radial guide 31, that is shown in the exemplary embodiment of FIG. 3 by 94. The rotary movement of the hoe-dipper stick 15 about the pivot 95 on the boom 7 is transmitted by means of an element 96 and a flexible rack 97 to an element 98 on the bracket 90, so that the arm 92 is controlled corresponding to the dipper stick 15. The lines 99 and 100 are the system lines that connect the pivot points E-D of the boom and A-D of the dipper stick and are relevant for the reduction.

I claim:

1. An excavating machine with position indication of its preferably parallel guided work implement formed, for example, as a back hoe, that by means of a pivoting drive is movable about a pivot point on a dipper stick, said dipper stick being rotatably fastened on a preferably multi-part boom articulated on the upper part of the excavating machine with a further pivoting drive, characterized in that for the position indication an indicator (64) is provided, that is controlled by a guide rod 33, that represents a connection between the swivel joint (31) of the work implement (29) and a parallel axis base swivel joint (34) on the pivotable excavating machine upper part (3) and that the position indication is calibratable on the indicator scale for inclination of the excavating machine in the linkage plane and for different distances (U) of the excavating machine from the work plane (42) through position adjustment of the axis parallel swivel joint (34) on the upper part (3) of the excavating machine.

2. The excavating machine according to claim 1 characterized in that the pivot angle of the work implement (29) about its swivel joint (31) is indicatable on a further scale (84) with a separate controlled indicator (83).

3. The excavating machine according to claim 1 characterized in that the extended position of the pivot drive (17) of the work implement (29) serves for the indication of the pivot angle of the work implement (29).

4. The excavating machine according to claims 1 through 3 characterized in that the guide rod (33) on the swivel joint (31) of the work implement (29) is radially coupled and is formed changeable in length between its mounting on the swivel joint (31) of the work implement (29) and the base swivel joint (34).

5. The excavating machine according to claim 4 characterized in that a flexible cord, is fastened at given points through the joint of the work implement (29) and the base swivel joint (34).

6. The excavating machine according to claim 1 characterized in that the guide rod is formed of a flexible tensioned means, that is fastened in the swivel joint (31) of the work implement (29) and lead about a cylinder, that is journalled in the parallel axis base swivel joint (34), said tensioned means being tensioned by means of a tensioning means.

7. An excavating machine according to claim 1 characterized in that the boom and dipper stick (7, 15) movable relative to each other intermediate the excavating machine upper part (3) and the work implement (29) are indicated in reduced scale by means of at least a rocket arm (92) and are followed by means of at least a rack drive (97).

8. An excavating machine according to claim 1 characterized in that with the locking together of the boom (7) and the movable dipper stick (15), the guide rod (33) is shortened through hinging of a rocker arm (92) journalled on the boom (7) that represents a reduction of the length A-D (100) of the dipper stick (15) in a similar representative proportion as the desired reduction of the length D-E (99) to the length d-e and is controlled by the rotary angle of the connection joint (96) between boom (7) and dipper stick (15).

9. An excavating machine according to claim 1 characterized in that the indicator (64) and its carrier scale (65) is placed in the viewing field of the excavating machine operator in the cab (5) and is connected by means of a rack drive (36) in the part of the axis parallel base swivel joint (34) arranged outside of the cab on the upper part of the excavating machine.

10. An excavating machine according to claim 2 characterized in that the indicator (83) and its scale carrier (84) is placed in the viewing field of the excavating machine operator in the cab (5) and is connected by means of a Bowden control cable (82) in the parts (80, 81) indicating the position of the work implement (29).

* * * * *